US009388565B2

(12) United States Patent
Gaudreau et al.

(10) Patent No.: US 9,388,565 B2
(45) Date of Patent: Jul. 12, 2016

(54) SIDING AND ROOFING PANELS AND METHOD FOR MOUNTING SAME

(71) Applicant: NOVIK INC., St. Augustin-de-Desmaures (CA)

(72) Inventors: Michel Gaudreau, Quebec (CA); Mathieu Piche, Quebec (CA); Martin Forget, Quebec (CA); Francois Bouchard, St-Redempteur (CA)

(73) Assignee: NOVIK INC., St-Augustin-de-Desmaures (CA)

( * ) Notice: Subject to any disclaimer, the term of this patent is extended or adjusted under 35 U.S.C. 154(b) by 0 days.

(21) Appl. No.: 13/722,521

(22) Filed: Dec. 20, 2012

(65) Prior Publication Data

US 2014/0174015 A1 Jun. 26, 2014

(51) Int. Cl.

| | |
|---|---|
| ***E04F 13/00*** | (2006.01) |
| ***E04B 1/38*** | (2006.01) |
| ***E04D 1/26*** | (2006.01) |
| ***E04F 13/18*** | (2006.01) |
| *E04F 13/08* | (2006.01) |
| *E04F 13/14* | (2006.01) |
| *E04D 1/30* | (2006.01) |

(52) U.S. Cl.

CPC . *E04B 1/38* (2013.01); *E04D 1/265* (2013.01); *E04F 13/0837* (2013.01); *E04F 13/0894* (2013.01); *E04F 13/185* (2013.01); *E04D 1/30* (2013.01); *E04F 13/0864* (2013.01); *E04F 13/147* (2013.01)

(58) Field of Classification Search

CPC ... E04F 13/0864; E04F 13/185; E04F 13/147; E04F 19/024; E04D 1/265; E04D 1/30

USPC ..... 52/531, 520, 521, 528, 518, 506.01, 52/302.1, 287.1, 530, 288.1, 539, 555, 52/747.1, 557, 276, 314, 188.1, 748, 591.2

See application file for complete search history.

(56) References Cited

U.S. PATENT DOCUMENTS

| | | | | |
|---|---|---|---|---|
| 448,733 | A | 3/1891 | Sagendorph | |
| 1,447,561 | A | 3/1923 | Overbury | |
| 1,467,510 | A | 9/1923 | Smith, Jr. | |
| 1,701,704 | A | 2/1929 | Stinson | |
| 1,767,374 | A | 6/1930 | Kirschbraun | |
| 1,795,913 | A | 3/1931 | Weaver | |
| 1,886,363 | A * | 11/1932 | Aufderheide | 52/385 |
| 1,981,324 | A * | 11/1934 | Peterson | 52/591.2 |
| 2,006,635 | A * | 7/1935 | Farr | 52/314 |
| 2,018,216 | A * | 10/1935 | MacLean | 428/168 |

(Continued)

OTHER PUBLICATIONS http://www.ecostar.carlisle.com/PDFs/majestic-install-guide.pdf Copyright 2005.

*Primary Examiner* — Brian Glessner
*Assistant Examiner* — Babajide Demuren
(74) *Attorney, Agent, or Firm* — Sutherland Asbill & Brennan LLP

(57) ABSTRACT

A wall or roof covering for mounting to a support surface, comprising: a plurality of panels securable to the support surface, each of the panels having a front surface comprising a covering section with simulated building elements, an opposed rear surface facing the support surface when secured thereto, a first marginal edge region and an opposed second marginal edge region, the first marginal edge region having an elongated receiving groove with an elongated aperture oriented one of substantially upwardly and substantially downwardly, the second marginal edge region being at least partially insertable in the first elongated receiving groove of a vertically-adjacent panel and being at least partially covered by a first section of the covering section of the vertically-adjacent panel when inserted therein.

34 Claims, 6 Drawing Sheets

(56) References Cited

U.S. PATENT DOCUMENTS 2,096,968 A 10/1937 Johnston
2,156,277 A 5/1939 Corbin, Jr.
2,201,175 A * 5/1940 Harshberger ..... 52/539
2,266,746 A * 12/1941 Elmendorf ..... 52/591.1
2,766,861 A 10/1956 Abramson
3,217,453 A * 11/1965 Medow ..... 52/314
3,417,531 A 12/1968 Jones
3,430,395 A 3/1969 Lashkow
3,504,467 A 4/1970 Hatch
3,593,479 A * 7/1971 Hinds et al. ..... 52/313
3,613,326 A * 10/1971 Mollman ..... 52/314
3,740,915 A * 6/1973 Mollman ..... 52/531
3,754,366 A 8/1973 Jansson et al.
3,783,570 A 1/1974 Storch
3,895,469 A * 7/1975 Kapitan ..... 52/592.5
3,968,610 A * 7/1976 Medow ..... 52/314
3,973,369 A 8/1976 Smith
3,977,145 A 8/1976 Dobby
4,015,391 A 4/1977 Epstein
4,033,499 A 7/1977 Butler
4,034,528 A 7/1977 Sanders et al.
4,070,432 A 1/1978 Tamaddon
4,070,843 A 1/1978 Leggiere et al.
4,096,679 A 6/1978 Naz
4,104,841 A 8/1978 Naz
4,186,538 A 2/1980 Marcum, Jr.
4,189,878 A 2/1980 Fitzgerald et al.
4,219,981 A 9/1980 Stewart et al.
4,251,967 A 2/1981 Hoofe, III
4,288,959 A 9/1981 Murdock
4,310,370 A 1/1982 Arai et al.
4,319,439 A 3/1982 Gussow
4,343,126 A 8/1982 Hoofe, III
4,382,993 A 5/1983 McIntyre et al.
4,434,200 A 2/1984 Fash et al.
4,437,602 A 3/1984 Kaczmarek
4,445,301 A 5/1984 Tanski
4,472,913 A 9/1984 Hickman
4,476,661 A 10/1984 Hoofe, III
4,498,267 A 2/1985 Beck
4,499,702 A 2/1985 Turner
4,522,002 A 6/1985 Davis
4,544,595 A 10/1985 Tomasson
4,580,383 A 4/1986 Pittman et al.
4,588,634 A 5/1986 Pagen et al.
4,592,185 A 6/1986 Lynch et al.
4,593,512 A 6/1986 Funaki
4,598,522 A 7/1986 Hoofe, III
4,617,770 A 10/1986 Hickman
4,617,774 A 10/1986 Pittman et al.
4,618,440 A 10/1986 Steinberg et al.
4,627,207 A 12/1986 Young et al.
4,641,472 A 2/1987 Young et al.
4,663,373 A 5/1987 Ravichandran et al.
4,671,753 A 6/1987 Payne
4,671,991 A 6/1987 Payne
4,680,911 A 7/1987 Davis et al.
4,712,351 A 12/1987 Kasprzak
4,717,614 A 1/1988 Bondoc et al.
4,729,202 A 3/1988 Ferland
4,749,533 A 6/1988 Payne
4,777,776 A 10/1988 Morrell
4,782,638 A 11/1988 Hovind
4,795,661 A 1/1989 Bondoc et al.
4,798,033 A 1/1989 Weidl
4,803,144 A 2/1989 Hosol
4,825,616 A 5/1989 Bondoc et al.
4,879,333 A 11/1989 Frazee
4,890,432 A 1/1990 Shepherd
4,936,071 A 6/1990 Karrfalt
4,940,844 A 7/1990 Blunt
4,946,992 A 8/1990 Falk et al.
5,039,740 A 8/1991 Anderson et al.
5,047,556 A 9/1991 Kohler et al.
5,060,444 A 10/1991 Paquette
5,076,037 A 12/1991 Crick
5,084,506 A 1/1992 Faler et al.
5,088,910 A 2/1992 Goforth et al.
5,096,046 A 3/1992 Goforth et al.
5,100,274 A 3/1992 Hasan et al.
5,106,609 A 4/1992 Bolich, Jr. et al.
5,124,098 A 6/1992 Vischer
5,126,392 A 6/1992 Nakashima
5,135,971 A 8/1992 Steiert et al.
5,141,983 A 8/1992 Hasegawa et al.
5,186,980 A 2/1993 Koschitzky
5,188,895 A 2/1993 Nishino
5,224,318 A * 7/1993 Kemerer ..... 52/521
5,229,207 A 7/1993 Paquette et al.
D339,875 S 9/1993 Shultz
5,249,402 A 10/1993 Crick
5,287,669 A 2/1994 Hannab et al.
5,288,787 A 2/1994 Sackmann et al.
5,295,339 A 3/1994 Manner
5,305,569 A 4/1994 Malmquist et al.
5,305,570 A 4/1994 Rodriguez et al.
5,344,007 A 9/1994 Nakamura et al.
5,347,784 A 9/1994 Crick et al.
5,349,802 A 9/1994 Kariniemi
5,363,623 A 11/1994 King
5,375,491 A 12/1994 Hannah et al.
5,400,558 A 3/1995 Hannah et al.
RE34,951 E 5/1995 Slosberg et al.
5,416,151 A 5/1995 Tanaka
5,421,134 A 6/1995 Hannah et al.
5,437,735 A 8/1995 Younan et al.
5,444,954 A 8/1995 Anderson
5,501,056 A 3/1996 Hannah et al.
5,524,412 A 6/1996 Corl
5,537,792 A 7/1996 Moliere
5,575,861 A 11/1996 Younan et al.
5,577,361 A 11/1996 Grabek, Jr. et al.
5,592,799 A 1/1997 Reinke
5,613,337 A 3/1997 Plath et al.
5,622,020 A 4/1997 Wood
5,636,481 A 6/1997 De Zen
5,644,886 A 7/1997 Ekmark et al.
5,675,955 A 10/1997 Champagne
5,687,090 A 11/1997 Chen et al.
5,731,033 A 3/1998 Hanisco
5,763,083 A 6/1998 Berrigan
5,784,848 A 7/1998 Toscano
5,813,184 A 9/1998 McKenna
5,821,294 A 10/1998 Pertinski
5,853,858 A 12/1998 Bondoc
5,878,543 A 3/1999 Mowery
5,916,100 A 6/1999 Mitchell et al.
5,922,379 A 7/1999 Wang
5,956,914 A 9/1999 Williamson
5,960,596 A 10/1999 Lyons, Sr.
5,992,116 A 11/1999 Ternes et al.
6,038,827 A 3/2000 Sieling
6,044,609 A 4/2000 Kim
6,050,041 A 4/2000 Mowery et al.
6,052,961 A 4/2000 Gibbs
6,058,670 A 5/2000 Sieling
6,082,064 A 7/2000 Mitchell et al.
6,092,302 A 7/2000 Berrigan
6,105,329 A 8/2000 Bondoc et al.
6,114,007 A 9/2000 Brandon et al.
6,122,878 A 9/2000 Pliley
6,153,293 A 11/2000 Dahl et al.
6,180,257 B1 1/2001 Brandt et al.
6,224,701 B1 5/2001 Bryant et al.
6,248,813 B1 6/2001 Zehner
6,258,876 B1 7/2001 Medoff et al.
6,282,858 B1 9/2001 Swick
6,295,777 B1 10/2001 Hunter et al.
6,301,856 B1 10/2001 Nasi
6,336,303 B1 1/2002 Vandeman et al.
6,360,508 B1 3/2002 Pelfrey et al.
6,361,851 B1 3/2002 Sieling et al.
6,421,975 B2 7/2002 Bryant et al.
6,436,471 B1 8/2002 Peterson

(56) References Cited

U.S. PATENT DOCUMENTS

| | | | | |
|---|---|---|---|---|
| 6,487,828 | B1 | 12/2002 | Philipps | |
| 6,550,362 | B1 | 4/2003 | Galinat et al. | |
| 6,579,605 | B2 | 6/2003 | Zehner | |
| 6,715,240 | B2 | 4/2004 | Beck et al. | |
| 6,715,250 | B2 | 4/2004 | Bryant et al. | |
| 6,786,804 | B2 | 9/2004 | Watanabe | |
| D507,837 | S | 7/2005 | King | |
| 6,939,036 | B2 | 9/2005 | Beck et al. | |
| 6,955,019 | B2 | 10/2005 | Donlin et al. | |
| 6,976,342 | B1 | 12/2005 | Kowalevich | |
| 6,983,571 | B2 | 1/2006 | Felton | |
| 6,988,345 | B1 | 1/2006 | Pelfrey et al. | |
| 7,008,213 | B2 | 3/2006 | King | |
| 7,089,709 | B2 | 8/2006 | Waggoner | |
| 7,207,145 | B2 | 4/2007 | Stucky et al. | |
| 7,240,461 | B1 | 7/2007 | Vandeman et al. | |
| 7,272,913 | B2 | 9/2007 | Mitchell | |
| 7,698,865 | B2 | 4/2010 | Pringle et al. | |
| 7,739,848 | B2 | 6/2010 | Trout | |
| 7,775,008 | B2 | 8/2010 | King | |
| 7,775,009 | B2 | 8/2010 | King | |
| 8,209,938 | B2 | 7/2012 | Gaudreau | |
| 2001/0039778 | A1 | 11/2001 | King | |
| 2002/0098110 | A1 | 7/2002 | Graham et al. | |
| 2003/0182888 | A1 | 10/2003 | Desbois et al. | |
| 2006/0032527 | A1 | 2/2006 | Stevens et al. | |
| 2007/0011966 | A1* | 1/2007 | Justice et al. | 52/309.1 |
| 2007/0107356 | A1 | 5/2007 | Steffes et al. | |
| 2007/0144096 | A1 | 6/2007 | O'Neil | |
| 2008/0083186 | A1 | 4/2008 | Gaudreau | |
| 2008/0083188 | A1* | 4/2008 | Swanson | 52/536 |
| 2008/0098683 | A1 | 5/2008 | Trabue et al. | |
| 2010/0088988 | A1 | 4/2010 | Gaudreau | |
| 2011/0023396 | A1* | 2/2011 | Schwarz et al. | 52/314 |

* cited by examiner

SIDING AND ROOFING PANELS AND METHOD FOR MOUNTING SAME

TECHNICAL FIELD OF THE INVENTION

The technical field relates to roofing and siding panels which are intended for roof and wall coverings and include simulated building elements, and more particularly, to roofing and siding panels engageable with like panels disposed vertically and horizontally adjacent thereto.

BACKGROUND

Siding and roofing coverings made of synthetic materials for facing exterior building walls and roofs are known. They can have the appearance of wooden clapboards, cedar shakes, masonry such as stones and bricks, and the like. The coverings include elongated panels which are individually nailed or screwed to building walls or roofs, i.e. to support surfaces. These panels are commonly nailed to the support surface in horizontal courses, beginning with the lowermost course. Typically, an upper marginal edge region of the panels is provided with a plurality of longitudinally-spaced outwardly and downwardly directed interlocked hook-shaped fingers protruding from a front surface, and a lower marginal edge region of the panels is provided with a bottom upturned hook-shaped rail formed on the underside of the panel, as disclosed in U.S. patent application 2008/0098683. The interlocked fingers of an underlying panel are engaged with the bottom rail of an overlying panel.

However, due to the size of the panels, the installer may have difficulty to engage all the interlocked fingers with the rail. Furthermore, the engagement of the fingers and the rail does not secure the overlying panel to the underlying panel and it can be difficult for the installer to hold and maintain a panel and simultaneously secure it to the support surface.

BRIEF SUMMARY OF THE INVENTION

It is therefore an aim to address at least partially the above mentioned issues.

According to a general aspect, there is provided a wall or roof covering for mounting to a support surface, comprising: a plurality of panels securable to the support surface, each of the panels having a front surface comprising a covering section with simulated building elements, an opposed rear surface facing the support surface when secured thereto, a first marginal edge region and an opposed second marginal edge region, the first marginal edge region having an elongated receiving groove with an elongated aperture oriented one of substantially upwardly and substantially downwardly, the second marginal edge region being at least partially insertable in the elongated receiving groove of a vertically-adjacent panel and being at least partially covered by a first section of the covering section of the vertically-adjacent panel when inserted in the elongated receiving groove.

In an embodiment, the first marginal edge region is an upper marginal edge region, the elongated receiving groove is an upper elongated receiving groove with the elongated aperture being oriented substantially upwardly, the second marginal edge region is a lower marginal edge region, and the lower marginal edge region is at least partially insertable in the upper elongated receiving groove of a lower vertically-adjacent panel and at least partially covered by an upper section of the covering section of the lower vertically-adjacent panel when inserted in the upper elongated receiving groove.

In an alternative embodiment, the first marginal edge region is a lower marginal edge region, the elongated receiving groove is a lower elongated receiving groove with the elongated aperture being oriented substantially downwardly, the second marginal edge region is an upper marginal edge region, and the upper marginal edge region is at least partially insertable in the lower elongated receiving groove of an upper vertically-adjacent panel and at least partially covered by a lower section of the covering section of the upper vertically-adjacent panel when inserted in the lower elongated receiving groove.

According to another general aspect, there is provided a wall or roof covering panel for mounting to a support surface, comprising: a front surface including a covering section with simulated building elements; an opposed rear surface facing the support surface when secured thereto; a first marginal edge region and an opposed second marginal edge region, the first marginal edge region comprising a first flange and an elongated receiving groove opened one of substantially upwardly and substantially downwardly, the elongated receiving groove extending between a first section of the covering section and the first flange and being configured to at least partially receive therein the second marginal edge region of a vertically-adjacent panel.

The wall or roof covering panel as claimed in claim 13, wherein the first marginal edge region is an upper marginal edge region, the second marginal edge region is a lower marginal edge region, the first flange is an upper flange, and the elongated receiving groove is an upper elongated receiving groove opened substantially upwardly and extending between an upper section of the covering section and the upper flange and being configured to at least partially receive therein the lower marginal edge region of an upper vertically-adjacent panel.

The wall or roof covering panel as claimed in claim 13, wherein the first marginal edge region is a lower marginal edge region, the second marginal edge region is an upper marginal edge region, the first flange is a lower flange, and the elongated receiving groove is a lower elongated receiving groove opened substantially downwardly and extending between a lower section of the covering section and the lower flange and being configured to at least partially receive therein the upper marginal edge region of a lower vertically-adjacent panel.

A wall or roof covering for mounting to a support surface, comprising: a plurality of panels securable to the support surface, each of the panels having a front surface comprising a covering section with simulated building elements, an opposed rear surface facing the support surface when secured thereto, a first marginal edge region, an opposed second marginal edge region, and two side marginal edge regions extending between the first marginal edge region and the second marginal edge region, one of the side marginal edge regions comprises a side receiving groove and the other one of the side marginal edge regions being at least partially insertable in the side receiving groove of a horizontally-adjacent panel.

In an embodiment, the first marginal edge region is an upper marginal edge region and the second marginal edge region is a lower marginal edge region.

In an alternative embodiment, the first marginal edge region is a lower marginal edge region and the second marginal edge region is an upper marginal edge region.

According to still another general aspect, there is provided a wall or roof covering panel securable to a support surface, comprising: a front surface including a covering section with simulated building elements, an opposed rear surface facing the support surface when secured thereto, a first marginal edge region, an opposed second marginal edge region, and two side marginal edge regions extending between the upper marginal edge region and the lower marginal edge region, one of the side marginal edge regions comprises a side receiving groove and the other one of the side marginal edge regions being at least partially insertable in the side receiving groove of a horizontally-adjacent panel.

In an embodiment, the first marginal edge region is an upper marginal edge region and the second marginal edge region is a lower marginal edge region.

In an alternative embodiment, the first marginal edge region is a lower marginal edge region and the second marginal edge region is an upper marginal edge region.

According to a further general aspect, there is provided a method for mounting a covering panel assembly to a support surface. The method comprises: positioning a first-course panel over the support surface with a rear face of the panel facing the support surface, the first-course panel comprising a covering section with simulated building elements, a first marginal edge region having an elongated receiving groove; securing the first-course panel to the support surface; positioning a second-course panel one of above and below and adjacent to the first-course panel, the second-course panel comprising a second marginal edge region; and translating one of downwardly and upwardly the second-course panel to insert the second marginal edge region of the second-course panel into the elongated receiving groove of the first-course panel until the second marginal edge region of the second-course panel is at least partially covered by a section of the covering surface of the first-course panel.

BRIEF DESCRIPTION OF THE DRAWINGS

FIG. 6 includes FIGS. 6*a* and 6*b*.

It will be noted that throughout the appended drawings, like features are identified by like reference numerals.

DETAILED DESCRIPTION

Figure 1:
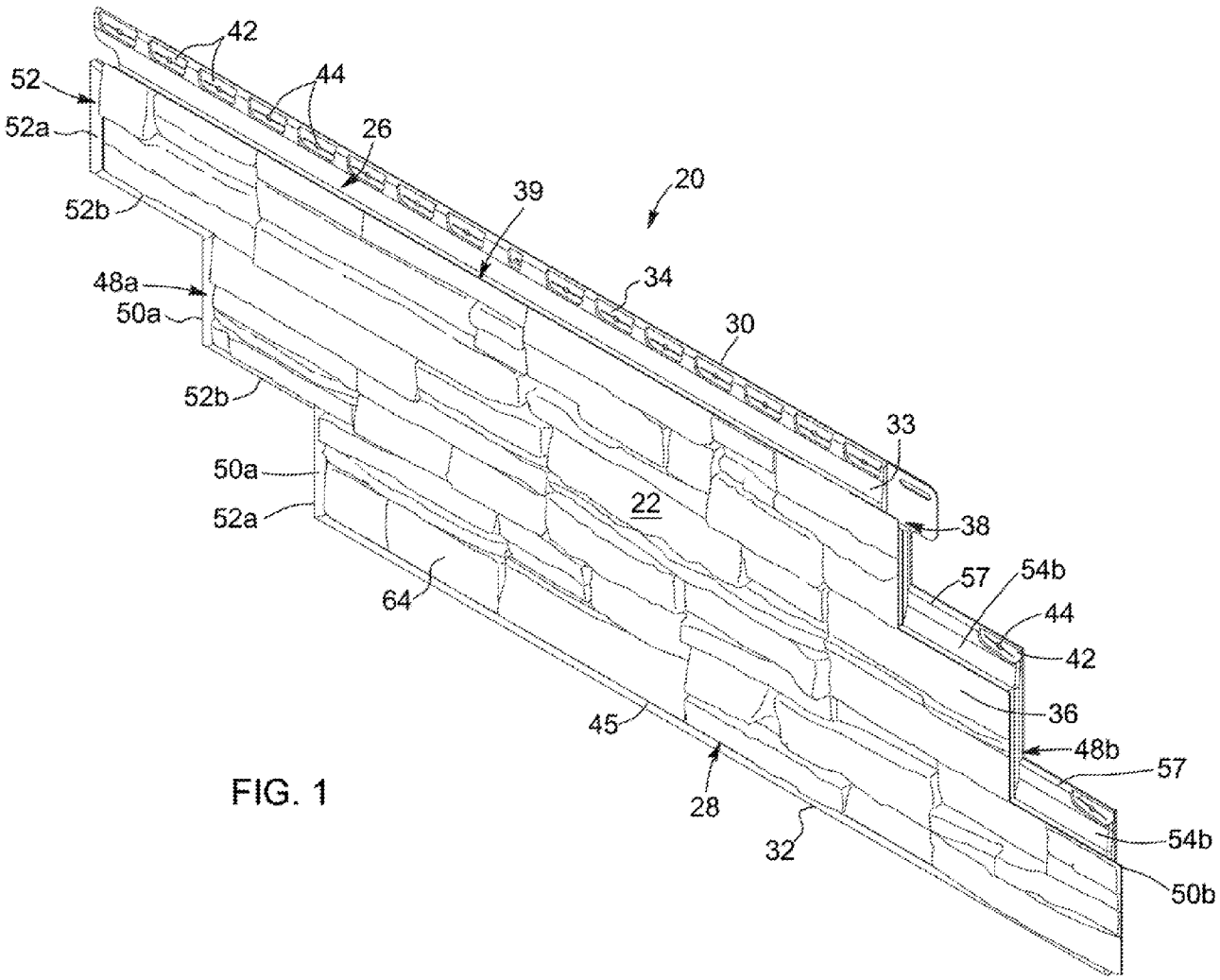
FIG. 1 is a perspective view of a panel for a covering system in accordance with an embodiment.
Figure 2:
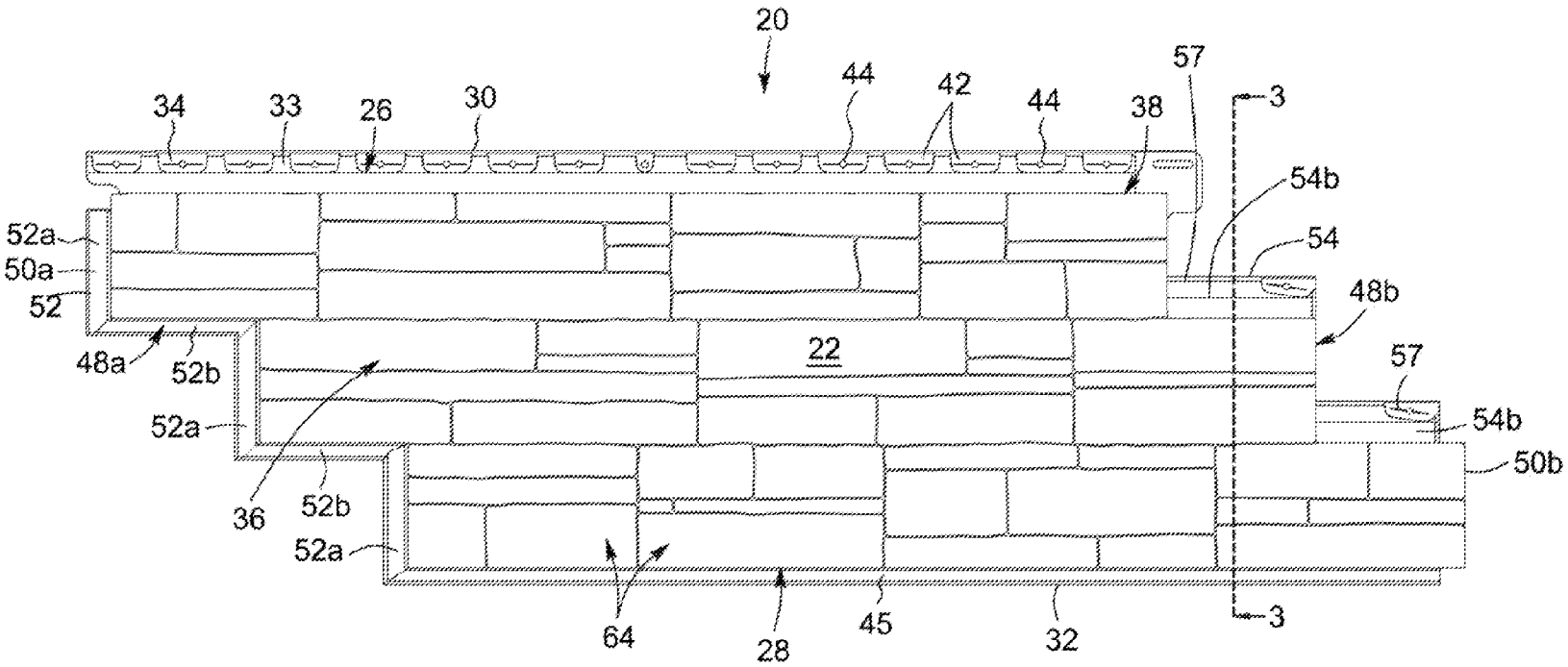
FIG. 2 is a front elevation view of the panel shown in FIG. 1.
Figure 4:
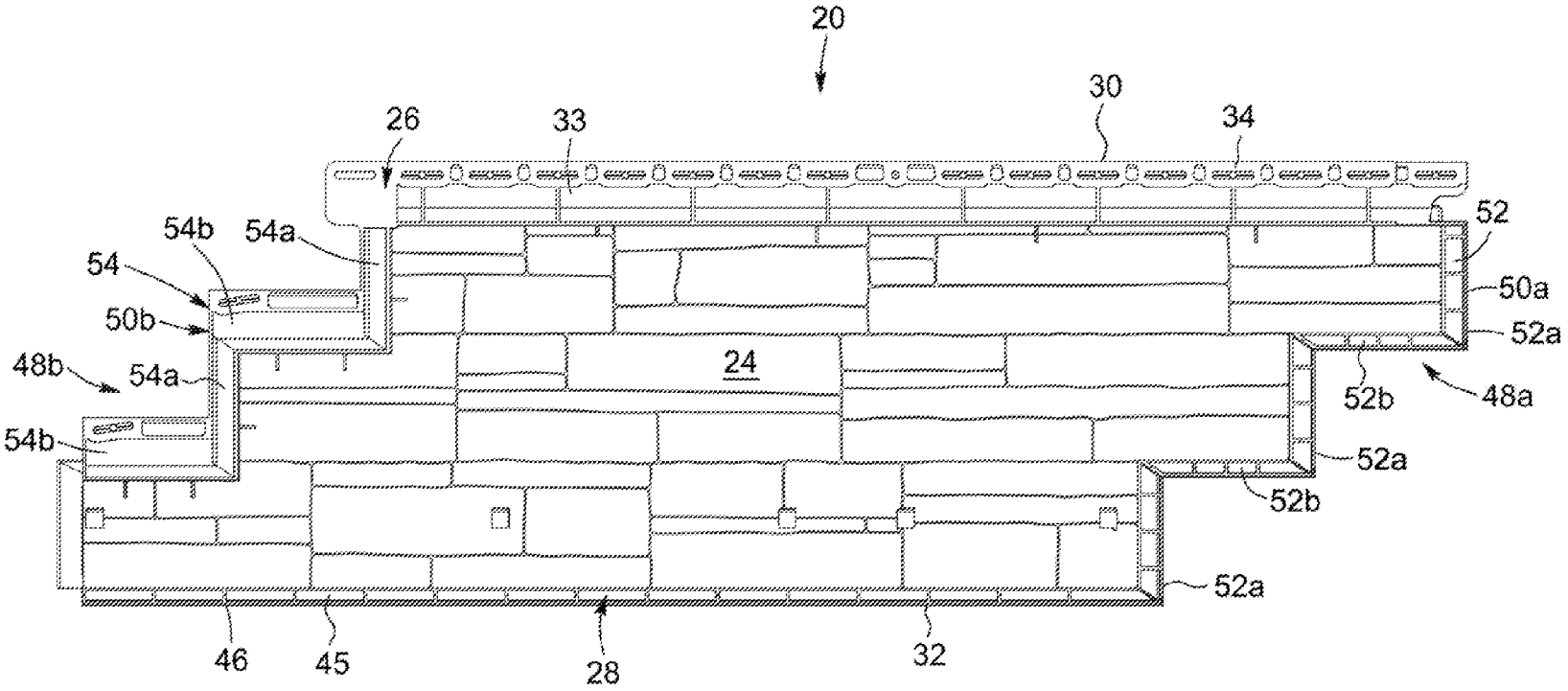
FIG. 4 is a rear elevation view of the panel shown in FIG. 1.

Referring to FIGS. 1, 2, and 4, there is shown an embodiment of a panel 20 for a covering system for substantially flat support surfaces such as building structure walls and roofs (not shown). The covering system includes a plurality of panels 20 adapted for engagement with like panels positioned either vertically or horizontally-adjacent thereto. The panels 20 of the covering system are typically mounted in a plurality of horizontal courses to the support surface. As it will be described in more details below, sections of vertically or horizontally-adjacent panels overlap to provide a continuous covering assembly.

Figure 3:
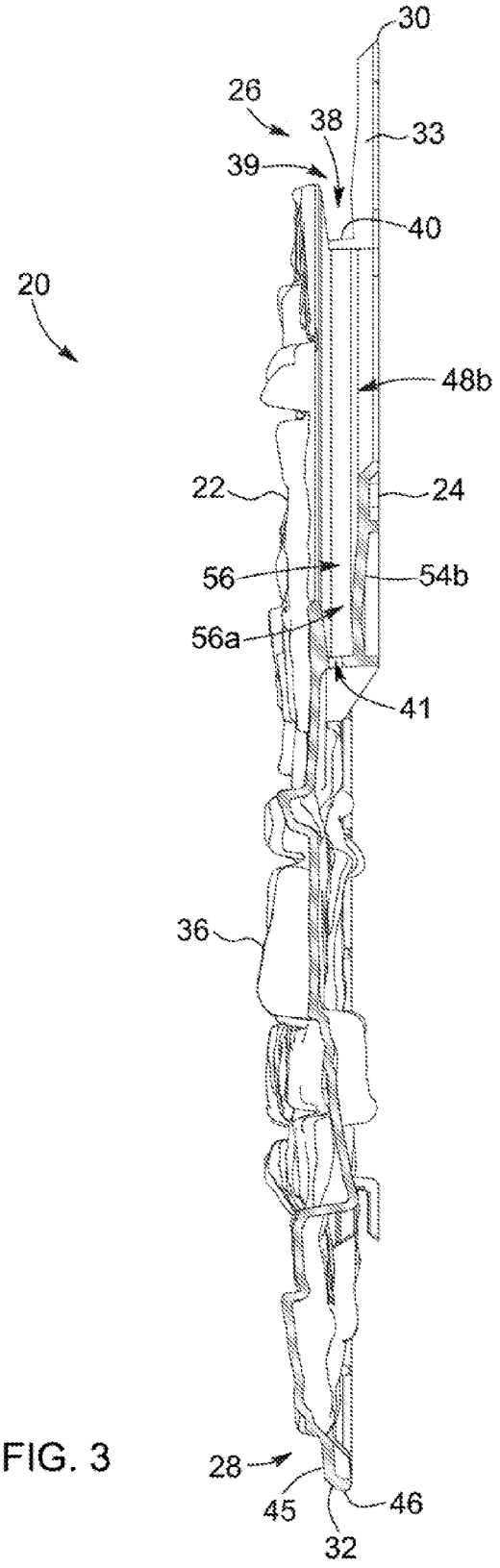
FIG. 3 is a sectional view, enlarged, taken along cross-section lines 3-3 of FIG. 2

Each panel 20 is characterized by a front surface 22 and an opposed rear surface 24 (FIGS. 3 and 4). The front surface 22 includes simulated building elements, as will be described in more details below. The rear surface 24 faces the support surface when the panel 20 is mounted thereto. The panel 20 includes an upper marginal edge region 26 and an opposed lower marginal edge region 28 with respective upper and lower edges 30, 32. The upper marginal edge region 26 comprises an upper flange 33 of a substantially uniform width extending across the top of the panel 20 and including a fastening strip 34. A covering section 36 extends below the upper marginal edge region 26 and overlaps a lower section of the upper flange 33. More particularly, the covering section 36 is spaced-apart transversally from the upper marginal edge region 26 and an upper elongated receiving groove 38 (FIG. 3) is defined inbetween, in the overlapping area, as it will be described in more details below. More particularly, an upper section of the covering section 36 is spaced-apart from the upper flange 33 and the upper elongated receiving groove 38 extends inbetween. The upper elongated receiving groove 38 comprises an elongated aperture 39 which faces upwardly, i.e. the elongated aperture 39 of the upper elongated receiving groove 38 is oriented substantially upwardly. An upper section of the upper flange 33 is not overlapped by the covering section 36 and includes the fastening strip 34.

In the embodiment shown, as shown in FIG. 3, the upper elongated receiving groove 38 extends continuously along the upper marginal edge region 26 of the panel 20 and has a substantially U-shaped cross-section with a bottom wall 40 and two side walls. A first one of the side walls is defined by an upper section of the covering section 36 overlapping the upper marginal edge region 26 and, more particularly, the upper flange 33, and a second one of the side walls is defined by the lower section of the upper flange 33 overlapped by the covering section 36. The upper elongated receiving groove 38 is open upwardly, i.e. its opening is oriented substantially upwardly for receiving a lower marginal edge region 28 of an upper vertically-adjacent panel. It is appreciated that the shape of the upper elongated receiving groove 38 can differ from the embodiment shown and that it can extend discontinuously along the panel 20. To prevent water accumulation in the upper elongated receiving groove 38, the lower section of the upper flange 33 and/or the bottom wall 40 can have apertures defined therein. In the embodiment shown, the bottom wall 40 is oriented substantially horizontally. However, in an alternative embodiment (not shown), it can be sloped longitudinally, between an upper end and a lower end to prevent water accumulation in the upper elongated receiving groove 38.

For securing the panels 20 to the support surface, the upper marginal edge region 26 of each panel 20 includes a fastening strip 34, shown in FIGS. 1 and 2, provided in the upper section of the upper flange 33. In the embodiment shown, the fastening strip 34 comprises a row of spaced-apart elongated grooves 42 including a substantially centered nailing hole 44. Nails or other appropriate fasteners are inserted in the nailing holes for securing the panels 20 to the support surface.

The lower marginal edge region 28 includes a lower flange 45 which extends continuously along the panel 20. In the embodiment shown, the lower flange 45 ends with a rearwardly extending lip 46 (FIG. 3). It can also be a tapered flange with a reducing thickness from the covering section 36 to the free end. In the embodiment shown, the lower flange 45 is free of simulated building elements. In an alternative embodiment (not shown), it can include simulated building elements.

The lower flange 45 is designed to be complementary to the upper elongated receiving groove 38 and insertable therein in a male-female member configuration. The lower marginal edge region 28 overlies outwardly the upper flange 33 of the upper marginal edge region 26 of a vertically-adjacent panel 20 when the panels 20 are mounted to the support surface. More particularly, the lower flange 45 of an upwardly positioned panel is inserted in the upper elongated receiving groove 38 of a lower vertically-adjacent panel (or downwardly positioned panel). The lower marginal edge region 28 is spaced-apart from the support surface by the upper marginal edge region of a vertically-adjacent panel, the lower vertically-adjacent panel. A lower section of the lower marginal edge region 28 of the upper vertically-adjacent panel is in turn covered by an upper section of the covering section 36 of the lower vertically-adjacent panel. In an alternative embodiment, the panel can be free of lower flange 45 and the lower marginal edge region 28 is inserted directly in the upper elongated receiving groove 38 of a lower vertically-adjacent panel.

The panel 20 further comprises two opposed and spaced-apart side marginal edge regions 48*a*, 48*b*, extending between the upper marginal edge region 26 and lower marginal edge region 28. In the embodiment shown, the side marginal edge regions 48*a*, 48*b* are staggered: a first side marginal edge region 48*a* having a reverse staircase configuration and a second side marginal edge region 48*b* having a complementary staircase configuration. Each of the side marginal edge regions 48*a*, 48*b* has a respective side edge 50*a*, 50*b* which conforms to the shape of the respective side marginal edge region 48*a*, 48*b* and has either a staircase configuration or a reverse staircase configuration.

The side marginal edge region 48*a* comprises a flange 52 having a reduced thickness in comparison to the adjacent covering section 36, from which the flange 52 extends outwardly, i.e. when mounted to a support surface the front surface of the flange 52 is substantially closer to the support surface than the front surface of the covering section 36. In the embodiment shown, the flange 52 is free of simulated building elements. In an alternative embodiment (not shown), it can include simulated building elements. The flange 52 extends continuously between vertically and horizontally oriented sections 52*a*, 52*b*, configured in an alternating configuration. At least sections of the flange 52 are not overlapped by the covering section 36, i.e. they extend outwardly from the covering section 36. In the embodiment shown, the vertically and horizontally oriented flange sections 52*a*, 52*b* are adjacent and not overlapped by the covering section 36. As the lower flange 45, the vertically and horizontally oriented flange sections 52*a*, 52*b* can end with a rearwardly extending lip and/or be tapered flanges with a reducing thickness from the covering section 36 to their free end. The flanges 52 are provided in the side marginal edge region 48*a* having a reverse staircase configuration. Thereby, the horizontally oriented sections 52*b* extend downwardly from the covering section 36.

The side marginal edge region 48*b* also comprises a flange 54 having a reduced thickness in comparison to the adjacent covering section 36, i.e. when mounted to a support surface the front surface of the flange 54 is substantially closer to the support surface than the front surface of the covering section 36. The flange 54 extends between vertically and horizontally oriented sections 54*a*, 54*b*, configured in an alternating configuration. In the embodiment shown, the lower flange 54 is free of simulated building elements. In an alternative embodiment (not shown), it can include simulated building elements. As the upper marginal edge region 26, the covering section 36 overlaps a lower section of the horizontally oriented flange sections 54*b*. The covering section 36 is spaced-apart transversally from the horizontally oriented flange sections 54*b* and a receiving groove 56*b* is defined inbetween, in the overlapping area, as it will be described in more details below. An upper section of the horizontally oriented flange sections 54*b* is not overlapped by the covering section 36 and includes a fastening strip 57. More particularly, each of the fastening strips 57 includes an elongated groove 42 including a substantially centered nailing hole 44 in which nails or other suitable fasteners can be inserted for further securing the panels 20 to the support surface. In the embodiment shown, the vertically oriented flange sections 54*a* are entirely overlapped by a section of the covering section 36 and a receiving groove 56*a* is defined inbetween. Thus, the receiving groove 56, including the vertically oriented sections 56*a* and the horizontally oriented sections 56*b*, extends continuously along the side edge 50*b*, in the side marginal edge region 48*b*, and has a staircase configuration which corresponds to the staircase configuration of the side marginal edge region 48*b*.

Figure 6A:
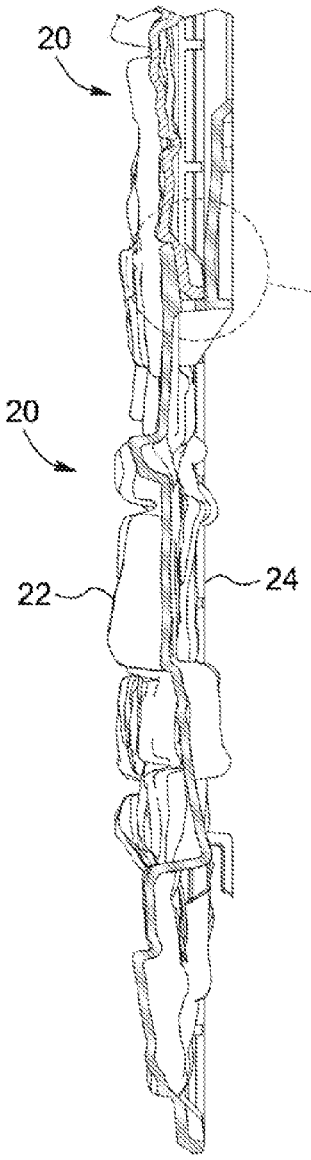
FIG. 6*a* is the sectional view of FIG. 3 with a second panel engaged in an upper vertically-adjacent configuration and FIG. 6*b* is an enlarged view of detail A of FIG. 6*a* showing the connection between the two vertically-adjacent panels.
Figure 6B:
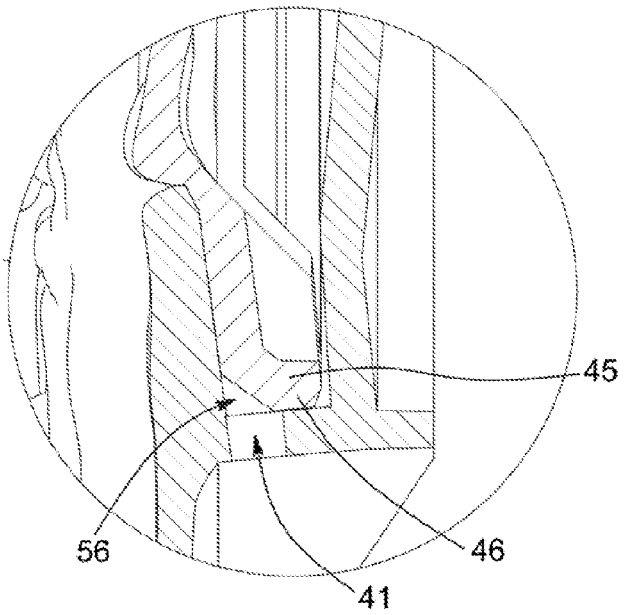

To prevent water accumulation in the horizontally oriented groove sections 56*b*, apertures can be defined in the lower section of the horizontally oriented flange sections 54*b* and/or the bottom wall defining the groove 56*b*. An aperture 41 defined in the bottom wall defining the groove 56*b* is shown in FIGS. 3 and 6.

The horizontally oriented flange sections 54*b* can be free of fastening strips 57. Furthermore, their configuration, including the number of grooves 42 and nailing holes 44 can vary from the embodiment shown.

The flange 52 and the receiving groove 56 of the side marginal edge region 48*a*, 48*b* are designed to be complementary and insertable in a male-female member combination. More particularly, when two panels are configured in a horizontally-adjacent configuration, the flange 52 of a first one of the panels is received in the receiving groove 56 of the second one of the panels. In an alternative embodiment, one of the side marginal edge region 48*a* can be designed to be insertable directly in the receiving groove 56 of the complementary side marginal edge region 48*b*.

In the embodiment shown, the complementary insertable flange and elongated groove cooperate for engaging two adjacent covering panels 20, which can either be vertically or horizontally adjacent.

Figure 5:
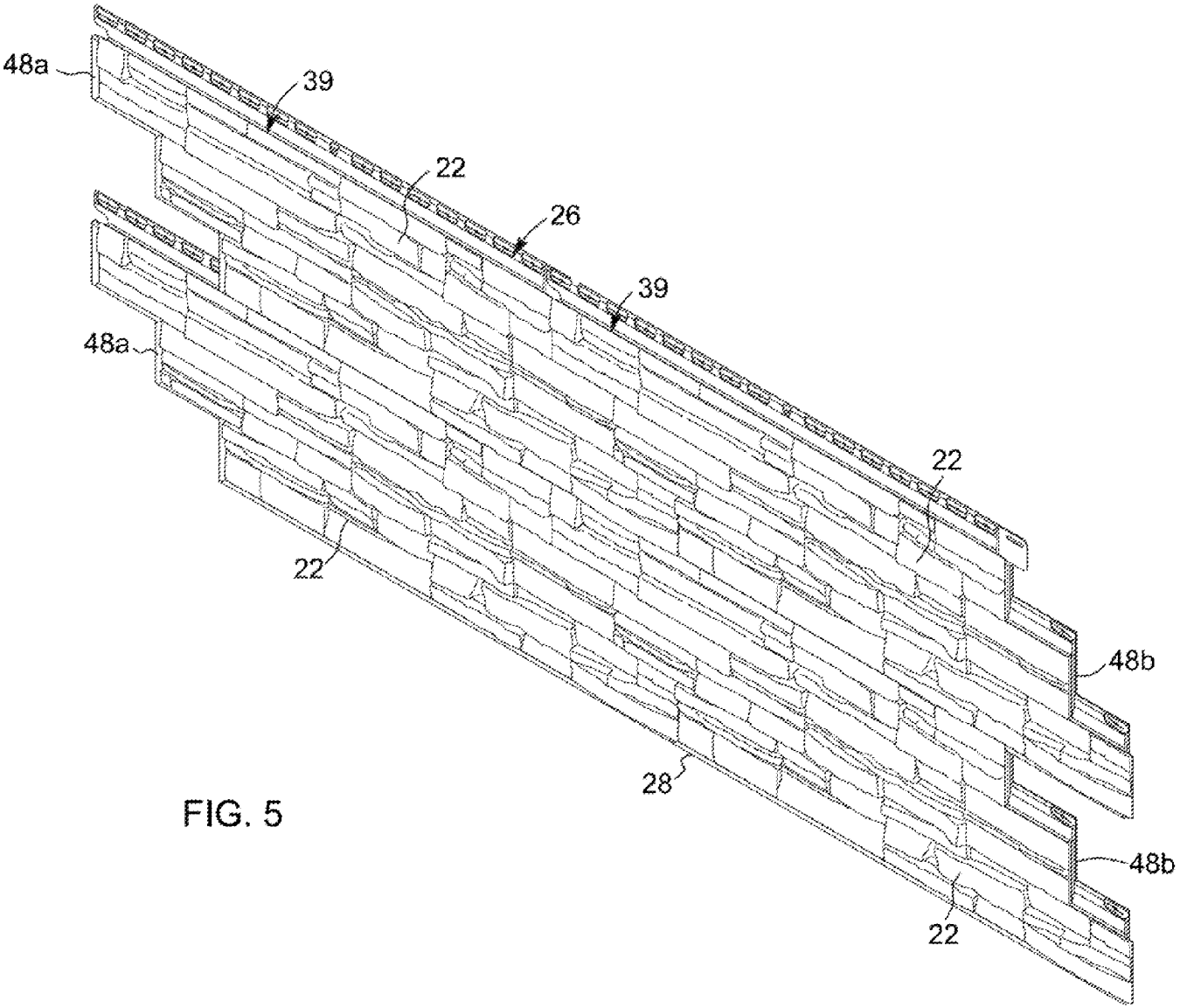
FIG. 5 is a perspective view of four panels of the embodiment shown in FIG. 1, engaged together in a vertically or horizontally-adjacent and overlapping configuration.

As shown in FIG. 5, the panels 20 are typically mounted in horizontal courses to the support surface, beginning with the lowermost course to be installed on the support surface. The complementary insertable flanges and receiving grooves are interlocking features that enable inter-engagement of engageable upper and lower marginal edge regions 26, 28 and side marginal edge regions 50*a*, 50*b* during installation. As it will be described in more details below, the inter-engagement of vertically and horizontally-adjacent panels 20 facilitates handling of the panels 20 while being secured to the support surface.

For mounting a lowermost course to the support surface, a first panel 20 is first secured thereto by inserting nails or other fasteners in fastening strips 34, 57 of the upper marginal edge region 26 and the horizontally oriented flange sections 54*b* and, more particularly, in the nailing holes 44. Then, a second panel is positioned in a horizontally-adjacent configuration to the first panel. More particularly, the vertically and horizontally oriented flange sections 52*a*, 52*b* of the side marginal edge region 48*a* of a second panel 20 are designed to be insertable in the receiving groove 56 defined between the vertically and horizontally oriented flange sections 54*a*, 54*b* of the side marginal edge region 48*b* and the overlapping covering section 36 of a first and horizontally-adjacent one of the panels 20 previously mounted to the support surface. In an alternative embodiment, the receiving groove 56 defined between the vertically and horizontally oriented flange sections 54*a*, 54*b* of the side marginal edge region 48*b* and the overlapping covering section 36 of a second panel 20 are designed to engage the vertically and horizontally oriented flange sections 52*a*, 52*b* of the side marginal edge region 48*a* of the first and horizontally-adjacent one of the panels 20 previously mounted to the support surface.

The vertically and horizontally oriented flange sections 52*a*, 52*b* are inserted by translating horizontally the second panel 20 with respect to the previously mounted panel 20. The horizontally-adjacent panels 20 are continuously engaged together since the insertable side flange 52 and the complementary receiving groove 56 extend continuously along the length of the panels 20. The thickness of the side flange 52 substantially corresponds to the width of the receiving groove 56 to facilitate frictional retention. Thus, during installation, the horizontally-adjacent panels 20 are first engaged together by inserting the insertable side flange 52 of the second panel 20 in the receiving groove 56 of the horizontally-adjacent panel 20, previously secured to the support surface. Following engagement, the second panel 20 can be secured to the support surface by inserting nails or other fasteners in fastening strips 34, 57 of the upper marginal edge region 26 and the horizontally oriented flange sections 54*b* and, more particularly, in the nailing holes 44. Due to the mechanical assembly of the insertable side flange 52 in the receiving groove 56, the second panel 20 is supported and it can be secured to the support surface without the need for manually supporting the weight of the panel 20. Other panels can be mounted with the above-described steps to complete the lowermost course or other horizontally extending courses of panels.

Alternatively, the horizontally-adjacent panel 20 can be engaged with a previously mounted panel 20 by positioning the horizontally-adjacent panel 20 adjacent and slightly above the previously mounted panel 20 and translating vertically the horizontally-adjacent panel 20 until the flanges 45, 52 are inserted in the corresponding receiving grooves 38, 56. The receiving grooves 38, 56 being open upwardly and the complementary flanges 45 and 52*b* extending downwardly from the covering section 36, it is thus possible to mount horizontally-adjacent panels 20 by translating one of them vertically with respect to the previously mounted panel 20. This feature can be advantageous to minimize transversal displacement of the panels 20 close to a J-trim of the covering assembly, for instance for the last panel of a horizontal course.

For mounting a panel course positioned above the lowermost course, which can be entirely or partially completed, an upper-course panel 20 is positioned in a vertically-adjacent configuration to the first panel (or any one of the panels 20 of the lowermost course). The insertable lower flange 45 of the lower marginal edge region 28 of each upper-course panel 20 is designed to be insertable in the upper elongated receiving groove 38 of each lower-course panel 20, vertically-adjacent to the upper-course and previously mounted to the support surface. The insertable lower flange 45 is inserted by translating vertically the upper-course panel 20 with respect to the previously mounted panel 20, as shown in FIG. 6. The vertically-adjacent panels 20 are continuously engaged together since the insertable lower flange 45 and the upper elongated receiving groove 38 extend continuously along the length of the panels 20. The thickness of the lower flange 45 substantially corresponds to the width of the upper elongated receiving groove 38 to facilitate frictional retention. Thus, during installation, the vertically-adjacent panels 20 are first engaged together by inserting the insertable lower flange 45 of the upper vertically-adjacent panel 20 in the upper elongated receiving groove 38 of the lower vertically-adjacent panel 20, one of the two panels being previously secured to the support surface. Following engagement, the upper vertically-adjacent panel 20 can be secured to the support surface by inserting nails or other fasteners in the fastening strips 34, 57 of the upper marginal edge region 26 and the horizontally oriented flange sections 54*b* and, more particularly, in the nailing holes 44. Due to the mechanical assembly of the insertable lower flange 45 in the upper elongated receiving groove 38, the overlying panel 20 is supported and it can be secured to the support surface without the need for manually supporting the weight of the panel 20. Other panels can be mounted with the above-described steps to begin an upper-course of panels.

To engage and secure a panel in a vertically-adjacent configuration to a first one of the panels and a horizontally-adjacent configuration to a second one of the panels, a combination of the steps performed to secure horizontally-adjacent panels and the steps performed to secure vertically-adjacent panels are performed.

It is appreciated that an upper-course panel can be engaged with two consecutive and horizontally-adjacent panels of a lower course, i.e. a first section of its lower marginal edge region 28 is inserted in the upper elongated receiving groove 38 of a first lower-course panel 20 and a second section of its lower marginal edge region 28 is inserted in the upper elongated receiving groove 38 of a second lower-course panel 20, horizontally-adjacent to the first lower-course panel 20. This can occur if the side edges 50*a*, 50*b* of the panels 20 are stepped, when mounting the panels 20 to the support surface, to create staggered rows of building elements 64.

It is understood that the reverse arrangement could be used. While in the illustrated embodiment, the insertable lower flange 45 protrudes from the lower marginal edge region 28 and the upper elongated receiving groove 38 is located in the upper marginal edge region 26, it will be understood that the reverse arrangement also could be used. More particularly, the lower marginal edge region 28 can include two spaced-apart flanges that define therebetween the elongated receiving groove 38 with a downwardly oriented aperture and the upper marginal edge region can include the corresponding insertable flange.

As mentioned above, the interlocking engagement of vertically-adjacent panels 20 is substantially continuous since the upper elongated receiving groove 38 and the insertable lower flange 45 extend continuously along the length of the panels 20. This facilitates proper positioning of the overlying panel 20 during installation as well as supporting the weight of the panel 20 sufficient to enable the installer to effect its securement on the support surface without cumbersome support of the overlying panel weight. Furthermore, as the upper elongated receiving groove 38 is provided on the front surface 22 of the panel 20, it is seen by the panel installer when assembling the panels 20 together.

In the embodiment shown, the elongated receiving grooves 38, 56 and the corresponding flanges 45, 52 extend continuously along the edges of the panel 20. However, in an alternative embodiment, the elongated receiving grooves 38, 56 and/or the insertable flanges 45, 52 can extend discontinuously along the edges of the panel 20. Similarly, only sections of the side marginal edge regions 48*a*, 48*b* can include complementary elongated groove(s) and insertable flange(s).

The side edges 50*a*, 50*b* and the side marginal edge regions 48*a*, 48*b* can be straight edges, one having a male member (protruding and insertable flange) and the other one having the complementary female member (the elongated groove) in which the male member is insertable. Furthermore, the design of the side marginal edge regions 48*a*, 48*b* can vary from the embodiment shown. In an alternative embodiment (not shown), the side edges 50*a*, 50*b* and the side marginal edge regions 48*a*, 48*b* can be free of engageable male and female member combinations.

As the lateral edges, in an alternative configuration, the upper and lower marginal edges can be staggered edges having complementary staircase and reverse staircase configurations.

On the front surface 22 of the panel 20, the covering section 36 includes simulated building elements 64. In the embodiment shown, the building elements 64 include a plurality of adjacent simulated stones. It is appreciated that, in alternative embodiments (not shown), the building elements 64 can include a plurality of vertically-adjacent, horizontally extending rows of shingles or other building elements. It is appreciated that the rows can be staggered relative to a preceding row or not. Furthermore, the covering section 36 can simulate any other types of building elements such as wood planks, slates, tiles, bricks, shingles such as cedar shingles, and the like.

Moreover, although the embodiments of the covering panel and corresponding parts thereof consist of certain geometrical configurations as explained and illustrated herein, not all of these components and geometries are essential to the invention and thus should not be taken in their restrictive sense. It is to be understood, as also apparent to a person skilled in the art, that other suitable components and cooperation thereinbetween, as well as other suitable geometrical configurations, may be used for the covering panel according to the present invention, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. A wall or roof covering for mounting to a support surface, comprising:

a plurality of panels securable to the support surface, each of the panels having a front surface comprising a covering section with simulated building elements, an opposed rear surface facing the support surface when secured thereto, a first marginal edge region and an opposed second marginal edge region, the first marginal edge region having an elongated receiving groove opened one of substantially upwardly and substantially downwardly defined between a flange of the first marginal edge region and a first section of the covering section, the second marginal edge region being at least partially insertable in the elongated receiving groove of a vertically-adjacent panel and being at least partially covered by the first section of the covering section of the vertically-adjacent panel when inserted in the elongated receiving groove with the first section of the covering section of the vertically-adjacent panel being uncovered, wherein the covering sections of vertically adjacent panels abut;

each one of the panels further comprising two side marginal edge regions extending between the first marginal edge region and the second marginal edge region, a side receiving groove extending in a first one of the side marginal edge regions from the first marginal edge region to the second marginal edge region and being defined between a first side flange and a first side section of the covering section with the covering section being aligned with or extending past the first side flange along a vertically-extending side edge of the panel, the first one of the side marginal edge regions having a staircase configuration with the side receiving groove comprising a plurality of sections opened laterally and upwardly; and a second one of the side marginal edge regions comprising a second flange extending from the first marginal edge region to the second marginal edge region and being entirely insertable in the side receiving groove of a horizontally-adjacent panel in a manner such that a second side section of the covering section, adjacent to the second flange, abuts the first side section of the covering section of the horizontally adjacent panel and the second flange is entirely covered by the first side section of the covering section of the horizontally adjacent panel, the second one of the side marginal edge regions having a complementary reverse staircase configuration with the flange comprising a plurality of vertically oriented sections and a plurality of horizontally oriented sections extending between the vertically oriented sections.

2. The wall or roof covering as claimed in claim 1, wherein the flange of the first marginal edge region is securable to the support surface and comprises a fastening strip juxtaposable to the support surface and the first section of the covering section is spaced apart from the support surface when the panel is mounted to the support surface, the covering section and the fastening strip being connected through a bottom wall defining therewith the elongated receiving groove.

3. The wall or roof covering as claimed in claim 1, wherein the second marginal edge region of each one of the panels consists of a flange at least partially insertable in the elongated receiving groove, the elongated receiving groove and the flange of the second marginal edge region extending continuously along a length of each one of the panels, and the flange of the second marginal edge region having a thickness corresponding to a width of the elongated receiving groove.

4. The wall or roof covering as claimed in claim 1, wherein the first side section of the covering section is uncovered when the second flange is inserted in the side receiving groove of the horizontally-adjacent panel.

5. The wall or roof covering as claimed in claim 1, wherein the first marginal edge region is an upper marginal edge region, the elongated receiving groove is an upper elongated receiving groove opened substantially upwardly, the second marginal edge region is a lower marginal edge region, and the lower marginal edge region is at least partially insertable in the upper elongated receiving groove of a lower vertically-adjacent panel and at least partially covered by an upper and uncovered section of the covering section of the lower vertically-adjacent panel when inserted in the upper elongated receiving groove.

6. The wall or roof covering as claimed in claim 1, wherein the first marginal edge region is a lower marginal edge region, the elongated receiving groove is a lower elongated receiving groove opened substantially downwardly, the second marginal edge region is an upper marginal edge region, and the upper marginal edge region is at least partially insertable in the lower elongated receiving groove of an upper vertically-adjacent panel and at least partially covered by a lower and uncovered section of the covering section of the upper vertically-adjacent panel when inserted in the lower elongated receiving groove.

7. A wall or roof covering panel for mounting to a support surface, comprising:

a front surface including a covering section with simulated building elements;

an opposed rear surface facing the support surface when secured thereto;

a first marginal edge region and an opposed second marginal edge region, the first marginal edge region comprising a first flange and an elongated receiving groove opened one of substantially upwardly and substantially downwardly, the elongated receiving groove extending between a first section of the covering section and the first flange and being configured to at least partially receive therein the second marginal edge region of a vertically-adjacent panel with the first section of the covering section being uncovered by the vertically-adjacent panel; and two side marginal edge regions extending between the first marginal edge region and the second marginal edge region, a side receiving groove extending in a first one of the side marginal edge regions along an outer edge thereof from the first marginal edge region to the second marginal edge region and being defined between a first side flange and a first side section of the covering section overlapping at least partially the first side flange and a second one of the side marginal edge regions comprises a second flange along an outer edge thereof extending from the first marginal edge region to the second marginal edge region and being entirely insertable in the side receiving groove of a horizontally-adjacent panel and covered by the first side section of the covering section of the horizontally-adjacent panel when inserted in the side receiving groove, the first side section of the covering section being uncovered when the second flange is inserted in the side receiving groove of the horizontally-adjacent panel and a second side section of the covering section, adjacent to the second flange, abutting the first side section of the covering section of the horizontally adjacent panel, wherein the first one of the side marginal edge regions has a staircase configuration, with the side receiving groove comprising a plurality of sections opened laterally and upwardly and the second one of the side marginal edge regions has a complementary reverse staircase configuration with the flange comprising a plurality of vertically oriented sections and a plurality of horizontally oriented sections extending between the vertically oriented sections.

8. The wall or roof covering panel as claimed in claim 7, wherein the first flange of the first marginal edge region is securable to the support surface and comprises a fastening strip juxtaposable to the support surface and the first section of the covering section being spaced apart from the support surface when the panel is mounted to the support surface, the first section of the covering section and the fastening strip being connected through a bottom wall defining therewith the elongated receiving groove.

9. The wall or roof covering panel as claimed in claim 7, wherein the elongated receiving groove is substantially U-shaped with two opposed side walls and a bottom wall with a first one of the side walls being defined by the first section of the covering section and a second one of the side walls being defined by the first flange of the first marginal edge region.

10. The wall or roof covering panel as claimed in claim 7, wherein the second marginal edge region consists of a second flange at least partially insertable in the elongated receiving groove of a vertically-adjacent panel and the second flange and the elongated receiving groove extend continuously along a length of the panel, and the second flange has a thickness corresponding to a width of the elongated receiving groove.

11. The wall or roof covering panel as claimed in claim 7, wherein the first marginal edge region is an upper marginal edge region, the second marginal edge region is a lower marginal edge region, the first flange is an upper flange, and the elongated receiving groove is an upper elongated receiving groove opened substantially upwardly and extending between an upper section of the covering section and the upper flange and being configured to at least partially receive therein the lower marginal edge region of an upper vertically-adjacent panel.

12. The wall or roof covering panel as claimed in claim 11, wherein the upper section of the covering section of a lower vertically-adjacent panel overlaps at least partially the lower marginal edge region of the upper vertically-adjacent panel and is exposed outwardly.

13. The wall or roof covering panel as claimed in claim 7, wherein the first marginal edge region is a lower marginal edge region, the second marginal edge region is an upper marginal edge region, the first flange is a lower flange, and the elongated receiving groove is a lower elongated receiving groove opened substantially downwardly and extending between a lower section of the covering section and the lower flange and being configured to at least partially receive therein the upper marginal edge region of a lower vertically-adjacent panel.

14. A wall or roof covering for mounting to a support surface, comprising: a plurality of panels securable to the support surface, each of the panels having a front surface comprising a covering section with simulated building elements, an opposed rear surface facing the support surface when secured thereto, a first marginal edge region, an opposed second marginal edge region, and two side marginal edge regions extending between the first marginal edge region and the second marginal edge region, a side receiving groove extending in a first one of the side marginal edge regions along an outer edge thereof from the first marginal edge region to the second marginal edge region and being defined between a first side flange and a first side section of the covering section overlapping at least partially the first side flange with the covering section being aligned with or extending past the first side flange along a vertically-extending side edge of the panel and a second one of the side marginal edge regions comprises a second flange along an outer edge thereof extending from the first marginal edge region to the second marginal edge region and being entirely insertable in the side receiving groove of a horizontally-adjacent panel and covered by the first side section of the covering section with the first side section of the covering section being exposed outwardly and a second side section of the covering section, adjacent to the second flange, abutting the first side section of the covering section of the horizontally adjacent panel, wherein the first one of the side marginal edge regions has a staircase configuration with the side receiving groove comprising a plurality of sections opened laterally and upwardly and the second one of the side marginal edge regions has a complementary reverse staircase configuration with the flange comprising a plurality of vertically oriented sections and a plurality of horizontally oriented sections extending between the vertically oriented sections.

15. The wall or roof covering as claimed in claim 14, wherein the first marginal edge region is an upper marginal edge region and the second marginal edge region is a lower marginal edge region.

16. The wall or roof covering as claimed in claim 15, wherein the lower marginal edge region of an upper vertically-adjacent panel overlies at least partially the upper marginal edge region of a lower vertically-adjacent panel when secured to the support surface and engaged together and an upper section of the covering section of the lower vertically-adjacent panel overlaps at least partially the lower marginal edge region of the upper vertically-adjacent panel with the upper section of the covering section of the lower vertically-adjacent panel being exposed outwardly.

17. The wall or roof covering as claimed in claim 16, wherein the upper marginal edge region comprises an upper flange securable to the support surface and an upper elongated receiving groove opened upwardly, the upper elongated receiving groove being defined between the upper section of the covering section and the upper flange and the lower marginal edge region is at least partially insertable in the upper elongated receiving groove of the lower vertically-adjacent panel and is at least partially covered by the upper section of the covering section of the lower vertically-adjacent panel.

18. The wall or roof covering as claimed in claim 17, wherein the upper flange of the upper marginal edge region comprises a fastening strip juxtaposable to the support surface and the upper section of the covering section being spaced apart from the support surface when the panel is mounted to the support surface, the upper section of the covering section and the fastening strip being connected through a bottom wall defining therewith the upper elongated receiving groove.

19. The wall or roof covering as claimed in claim 17, wherein the upper elongated receiving groove extends continuously along a length of each one of the panels and the upper elongated receiving groove is substantially U-shaped with two opposed side walls and a bottom wall with a first one of the side walls being defined by the upper section of the covering section and a second one of the side walls being defined by an upper flange of the upper marginal edge region.

20. The wall or roof covering as claimed in claim 17, wherein the lower marginal edge region of each one of the panels comprises a lower flange at least partially insertable in the upper elongated receiving groove and extending continuously along a length of each one of the panels and the lower flange has a thickness corresponding to a width of the upper elongated receiving groove.

21. The wall or roof covering as claimed in claim 14, wherein the first marginal edge region is a lower marginal edge region and the second marginal edge region is an upper marginal edge region.

22. A wall or roof covering panel securable to a support surface, comprising:

a front surface including a covering section with simulated building elements, an opposed rear surface facing the support surface when secured thereto, a first marginal edge region, an opposed second marginal edge region, and two side marginal edge regions extending between the first marginal edge region and the second marginal edge region, wherein a first one of the side marginal edge regions comprises a side receiving groove extending from the first marginal edge region to the second marginal edge region and defined between a first side flange and a first side section of the covering section with the covering section being aligned with or extending past the first side flange along a vertically-extending side edge of the panel and a second one of the side marginal edge regions comprises a second flange extending from the first marginal edge region to the second marginal edge region and being entirely insertable in the side receiving groove of a horizontally-adjacent panel and being entirely covered by the first side section of the covering section with the first side section being exposed outwardly when the second flange is inserted in the side receiving groove of the horizontally-adjacent panel and a second side section of the covering section, adjacent to the second flange, abutting the first side section of the covering section of the horizontally adjacent panel, wherein the first one of the side marginal edge regions has a staircase configuration with the side receiving groove comprising a plurality of sections opened laterally and upwardly and the second one of the side marginal edge regions has a complementary reverse staircase configuration with the flange comprising a plurality of vertically oriented sections and a plurality of horizontally oriented sections extending between the vertically oriented sections.

23. The wall or roof covering panel as claimed in claim 22, wherein the first marginal edge region is an upper marginal edge region and the second marginal edge region is a lower marginal edge region.

24. The wall or roof covering panel as claimed in claim 23, wherein the upper marginal edge region comprises an upper flange securable to the support surface and an upper elongated receiving groove opened upwardly, the upper elongated receiving groove being defined between an upper section of the covering section and the upper flange, and the lower marginal edge region is at least partially insertable in the upper elongated receiving groove of a lower vertically-adjacent panel and is at least partially covered by the upper section of the covering section of the lower vertically-adjacent panel with the upper section of the covering section of the lower vertically-adjacent panel being exposed outwardly.

25. The wall or roof covering panel as claimed in claim 24, wherein the upper flange of the upper marginal edge region comprises a fastening strip juxtaposable to the support surface and the upper section of the covering section being spaced apart from the support surface when the panel is mounted to the support surface, the upper section of the covering section and the fastening strip being connected through a bottom wall defining therewith the upper elongated receiving groove.

26. The wall or roof covering panel as claimed in claim 24, wherein the upper elongated receiving groove extends continuously along a length of the panel and the upper elongated receiving groove is substantially U-shaped with two opposed side walls and a bottom wall with a first one of the side walls being defined by the upper section of the covering section and a second one of the side walls being defined by an upper flange of the upper marginal edge region.

27. The wall or roof covering panel as claimed in claim 24, wherein the lower marginal edge region consists of a lower flange at least partially insertable in the upper elongated receiving groove and extending continuously along a length of the panel and the lower flange has a thickness corresponding to a width of the upper elongated receiving groove.

28. The wall or roof covering panel as claimed in claim 22, wherein the first marginal edge region is a lower marginal edge region and the second marginal edge region is an upper marginal edge region.

29. The wall or roof covering as claimed in claim 14, wherein the side receiving groove is further defined by a vertically extending end wall connecting the first side flange and the covering section, spaced-apart from a vertically extending side edge of the panel.

30. The wall or roof covering as claimed in claim 14, wherein the side receiving groove is further defined by a bottom wall connecting an edge of the first side flange and the covering section.

31. The wall or roof covering as claimed in claim 30, wherein the bottom wall comprises at least one aperture defined therein.

32. The wall or roof covering panel as claimed in claim 22, wherein the side receiving groove is further defined by a vertically extending end wall connecting the first side flange and the covering section, spaced-apart from the vertically extending side edge of the panel.

33. The wall or roof covering panel as claimed in claim 22, wherein the side receiving groove is further defined by a bottom wall connecting an edge of the first side flange and the covering section.

34. The wall or roof covering panel as claimed in claim 33, wherein the bottom wall comprises at least one aperture defined therein.

* * * * *